US007575604B2

(12) United States Patent
Galick et al.

(10) Patent No.: US 7,575,604 B2
(45) Date of Patent: Aug. 18, 2009

(54) DRYCLEANING METHOD

(75) Inventors: Paul E. Galick, West Chester, PA (US); Frank J. Liotta, Jr., Downingtown, PA (US); Mark A. Liepa, Exton, PA (US)

(73) Assignee: Lyondell Chemical Technology, L.P., Wilmington, DE (US)

( * ) Notice: Subject to any disclaimer, the term of this patent is extended or adjusted under 35 U.S.C. 154(b) by 0 days.

(21) Appl. No.: 11/544,326

(22) Filed: Oct. 6, 2006

(65) Prior Publication Data

US 2008/0083072 A1 Apr. 10, 2008

(51) Int. Cl.
*D06L 1/00* (2006.01)
*D06L 1/02* (2006.01)
*D06L 1/20* (2006.01)

(52) U.S. Cl. ..... 8/142; 8/137; 8/141; 134/34; 134/11; 134/12

(58) Field of Classification Search ..... 8/142, 8/137, 141; 134/34, 11, 12
See application file for complete search history.

(56) References Cited

U.S. PATENT DOCUMENTS

| | | | | |
|---|---|---|---|---|
| 5,888,250 | A | 3/1999 | Hayday et al. | 8/142 |
| 6,042,617 | A | 3/2000 | Berndt | 8/142 |
| 6,063,135 | A | 5/2000 | Berndt et al. | 8/142 |
| 6,086,634 | A | 7/2000 | Smith | 8/142 |
| 6,273,919 | B1 | 8/2001 | Hayday | 8/142 |
| 6,355,072 | B1 | 3/2002 | Racette et al. | 8/142 |
| 6,558,432 | B2 | 5/2003 | Schulte et al. | 8/142 |
| 6,736,859 | B2 | 5/2004 | Racette et al. | 8/142 |
| 6,755,871 | B2 | 6/2004 | Damaso et al. | 8/137 |
| 6,828,292 | B2 | 12/2004 | Noyes et al. | 510/287 |
| 7,087,094 | B2 | 8/2006 | Galick et al. | 8/142 |
| 7,097,715 | B1 | 8/2006 | Racette et al. | 134/26 |
| 7,147,670 | B2 | 12/2006 | Schulte et al. | 8/142 |
| 2003/0087782 | A1* | 5/2003 | Evers et al. | 510/285 |
| 2003/0220219 | A1 | 11/2003 | Schulte et al. | 510/407 |
| 2004/0173246 | A1 | 9/2004 | Damaso et al. | 134/26 |
| 2005/0044636 | A1* | 3/2005 | Galick et al. | 8/115.51 |
| 2006/0042021 | A1 | 3/2006 | Galick et al. | 8/142 |
| 2006/0123562 | A1* | 6/2006 | Ghosh et al. | 8/147 |

FOREIGN PATENT DOCUMENTS

| | | |
|---|---|---|
| WO | WO 01/16422 | 3/2001 |
| WO | WO 01/29306 | 4/2001 |

OTHER PUBLICATIONS

ECOSOLV Drycleaning Fluid Materials Safety Data Sheet, Sep. 23, 2002.*

* cited by examiner

*Primary Examiner*—Lorna M Douyon
*Assistant Examiner*—Amina Khan
(74) *Attorney, Agent, or Firm*—Jonathan L. Schuchardt

(57) ABSTRACT

A drycleaning method is disclosed. The method uses a composition comprising 30 to 90 wt. % of a dipropylene glycol $C_3$-$C_4$ alkyl ether, 5 to 65 wt. % of one or more $C_{10}$-$C_{15}$ hydrocarbons, and 1 to 10 wt. % of water. The method combines acceptable stain removal with faster-than-expected evaporability, particularly at the elevated temperatures used in commercial drycleaning.

13 Claims, No Drawings

DRYCLEANING METHOD

FIELD OF THE INVENTION

The invention relates to a method for drycleaning fabrics and fibers. In particular, the invention is a drycleaning method that uses a composition containing a dipropylene glycol $C_3$-$C_4$ alkyl ether, hydrocarbons, and water.

BACKGROUND OF THE INVENTION

Conventional methods for drycleaning use a chlorinated hydrocarbon solvent, most commonly perchloroethylene (PERC) in combination with small amounts of water and detergents. Although PERC is fabric-safe, non-flammable, and easily recycled, it poses environmental risks and health hazards. In particular, PERC has toxicological issues associated with its use, the EPA lists it as a Hazardous Air Pollutant (HAP), and it is non-biodegradable.

In response to the safety and health risks of PERC, the industry has commercialized less-toxic alternatives. For example, GreenEarth Cleaning, produces a cyclic siloxane, which is optionally combined with a glycol ether or another organic solvent (see, e.g., U.S. Pat. Nos. 6,042,617 and 6,063,135). Another common alternative is hydrocarbons. Hydrocarbons used in the drycleaning industry are typically blends of $C_{10}$ to $C_{15}$ aliphatic compounds. Examples include DF-2000 fluid (a product of ExxonMobil Chemical) and Eco-Solv® drycleaning fluid (a product of Chevron Phillips Chemical).

Glycol ethers, which offer good cleaning properties for both oil-soluble and water-soluble stains, are another attractive alternative. Notable glycol ethers include propylene glycol tert-butyl ether, propylene glycol n-butyl ether, dipropylene glycol tert-butyl ether (DPtB), and dipropylene glycol n-butyl ether (DPnB) as taught in U.S. Pat. Nos. 5,888,250 or 6,273,919. Mixtures of dipropylene glycol n-propyl ether (DPnP) and water (U.S. Pat. No. 7,087,094) or dipropylene glycol dimethyl ether (DMM) and water (U.S. Pat. Appl. Pub. No. 2006/0042021) have also been taught. Other mixtures containing DPnP or DMM and water or other solvents are described in WO 01/16422 (DPnP combined with less than 1 wt. % of water) and U.S. Pat. No. 6,828,292 (85 wt. % of DMM combined with 10 wt. % of water). U.S. Pat. No. 6,755,871 teaches a pressurized cleaning system containing one or more organic solvents including glycol ethers and aliphatic hydrocarbons. U.S. Pat. No. 6,086,634 teaches a drycleaning composition comprising glycol ethers, water, and polysulfonic acid. None of the above-mentioned references describes particular mixtures of dipropylene glycol $C_3$-$C_4$ alkyl ethers, water, and $C_{10}$-$C_{15}$ aliphatic hydrocarbon mixtures.

Drycleaners using glycol ether cleaners occasionally report odors from residual solvent in drycleaned fabrics or garments. Consumers more accustomed to the odor of residual PERC also notice it. Not surprisingly, the odor is most noticeable in heavy fabrics, multilayer textiles, and garments with structural components such as shoulder pads. While the odor can be reduced by increasing the temperature or drying time, either approach increases the cost of an already energy-intensive operation and slows the production rate. Another possible approach would be to combine a higher boiling glycol ether with a more-volatile solvent to enhance evaporation. However, this approach would do little to remove the last traces of the higher-boiling glycol ether.

Although progress in finding replacements for PERC has been made, consumer acceptance is key to adoption of safer alternatives. An ideal drycleaning method would clean both oil and water-based stains, with a minimum of fabric shrinkage. In addition, the method would promote fast evaporation and allow for complete or near-complete removal of solvent so that the drycleaned article is essentially odorless. Ideally, this could be done without increasing the temperature and time at which garments are drycleaned.

SUMMARY OF THE INVENTION

The invention is a method for drycleaning a fiber, fabric, or garment. The method comprises using a composition comprising 30 to 90 wt. % of a dipropylene glycol $C_3$-$C_4$ alkyl ether, 5 to 65 wt. % of one or more $C_{10}$-$C_{15}$ hydrocarbons, and 1 to 10 wt. % of water.

We surprisingly found that certain combinations of dipropylene glycol $C_3$-$C_4$ alkyl ethers, aliphatic hydrocarbons, and water evaporate significantly faster than expected, particularly at the elevated temperatures used in commercial drycleaning. This method has improved effectiveness in reducing the residual solvent in the fabric when compared to the same method using mixtures of the glycol ethers and water alone. Moreover, the method reduces or eliminates the odor associated with the drycleaning solvent without the additional expense of increasing drying times or temperatures. In sum, the method offers fast evaporation and acceptable cleaning performance while providing a fabric-safe, environmentally acceptable alternative to PERC.

DETAILED DESCRIPTION OF THE INVENTION

The method of the invention is used for drycleaning fabrics. Suitable fabrics include any textile articles that benefit from the drycleaning process. They include products made from a wide variety of natural and synthetic fibers, including, e.g., cotton, wool, silk, rayon, polyester, nylon, acetates, polyolefins, acrylics, spandex, and the like, and blends of these. Suitable fabric uses include garments and accessories, bedding, furniture coverings, rugs, wall coverings, draperies, napkins, tablecloths, and so on. The method can also be used to dryclean a fiber (e.g., wool fiber) before it is used to make a fabric.

The method uses a composition containing one or more dipropylene glycol $C_3$-$C_4$ alkyl ethers. Suitable glycol ethers include dipropylene glycol n-propyl ether (DPnP), dipropylene glycol isopropyl ether, dipropylene glycol n-butyl ether (DPnB), dipropylene glycol isobutyl ether, dipropylene glycol sec-butyl ether, dipropylene glycol tert-butyl ether (DPtB), and mixtures of these.

Dipropylene glycol $C_3$-$C_4$ alkyl ethers are normally produced as a mixture of isomers, which may have a primary or secondary hydroxyl group, and may have head-to-head or head-to-tail configuration of the oxypropylene groups. The major isomer depends on reaction conditions. Minor amounts of other compounds generated as by-products in the manufacture of the dipropylene glycol $C_3$-$C_4$ alkyl ethers may also be present. All of the dipropylene glycol propyl ether isomers have the molecular formula $C_9H_{20}O_3$, while the butyl ethers all have the formula $C_{10}H_{22}O_3$.

DPnP and DPnB are commercially available as Dowanol® DPnP and Dowanol® DPnB from Dow Chemical Company. DPnP, DPnB, and DPtB are commerically available as ARCOSOLV® DPnP, ARCOSOLV® DPnB, and ARCOSOLV® DPtB, from Lyondell Chemical Company.

Compositions useful in practicing the invention comprise from 30 to 90 wt. % of a dipropylene glycol $C_3$-$C_4$ alkyl ether.

More preferably, the compositions contain from 45 to 80 wt. %, and most preferably from 60 to 70 wt. %, of the dipropylene glycol $C_3$-$C_4$ alkyl ether.

The drycleaning composition also includes one or more $C_{10}$-$C_{15}$ hydrocarbons. Usually, a blend of $C_{10}$-$C_{15}$ hydrocarbons, preferably a mixture of saturated aliphatic hydrocarbons, is used. Suitable hydrocarbon mixtures are formulated to provide a desired flash point or boiling point range. Particularly preferred are hydrocarbon mixtures that are predominantly $C_{10}$-$C_{13}$ hydrocarbons. Examples include ExxonMobil's DF-2000® and Actrel 3360L® solvents, Caled's Hydroclene® solvent, Shell's Shellsol D-600 solvent, and Chevron Phillips's EcoSolv® solvent. Other suitable though less preferred blends use mixtures with predominantly $C_{13}$-$C_{15}$ hydrocarbons. Examples include ExxonMobil's Isopar M®, and Exxsol D95® solvents.

To maximize safety in drycleaning operations, the hydrocarbons preferably have a flash point greater than 140° F. (i.e., greater than 60° C.). Each of the solvent mixtures listed above satisfies that criterion. The lower-boiling hydrocarbon mixtures typically have boiling ranges from 180° C to 210° C., while the higher-boiling hydrocarbon mixtures usually boil from 220° C. to 270° C.

Suitable drycleaning compositions have from 5 to 65 wt. % of the hydrocarbons, more preferably from 20 to 50 wt. %, and most preferably from 30 to 50 wt. %.

The compositions also contain from 1 to 10 wt. % of water, which helps to dissolve many soils, particularly those with substantial water solubility such as blood or tea. Too much water in the drycleaning formulation should be avoided, however, because it will cause many fabrics (e.g., cotton or wool) to shrink. Shrinkage values greater than about 2% are generally undesirable. Preferably, the amount of water present is 2 to 5 wt. %, more preferably 2.5 to 4 wt. %.

The relative amounts of the dipropylene glycol $C_3$-$C_4$ alkyl ether, hydrocarbons, and water are balanced to maximize the cleaning properties of the composition and to minimize the amount of residual solvent remaining in the drycleaned article. While either of glycol ethers or hydrocarbon mixtures have been taught elsewhere for drycleaning, any benefit arising from their combined use in the presence of a small proportion of water was unknown. In general, compositions useful herein provide acceptable cleaning performance when compared with commercially available drycleaning compositions. As an added bonus, however, the compositions offer better-than-expected evaporability.

While the hydrocarbon blends evaporate more quickly than dipropylene glycol $C_3$-$C_4$ alkyl ethers, we surprisingly found that mixtures of the glycol ethers and hydrocarbons evaporate faster than predicted from the evaporation times of the individual components, especially at elevated temperature (see Tables 1 to 6, below). To determine the improvement in evaporability, we first measured evaporation times for each of dipropylene glycol $C_3$-$C_4$ alkyl ether/water (95:5) and DF-2000 (hydrocarbon mixture) at room temperature and 77° C. By using a weighted average, we were able to predict an evaporation time for any mixture of glycol ether and hydrocarbons. For instance, a mixture of 90 wt. % of DPnP/water (95:5) and 10 wt. % of DF-2000 has a predicted evaporation time at 77° C. of 2,596 seconds (see sample calculations) compared with an observed value of 2,100 seconds. The observed value is therefore 19% faster than expected. Similar calculations were performed to predict evaporability for hydrocarbon mixtures with DPnB or DPtB.

Overall, we surprisingly found that the evaporability of mixtures containing dipropylene glycol $C_3$-$C_4$ alkyl ethers, $C_{10}$-$C_{15}$ hydrocarbons, and water is temperature dependent. Room temperature measurements indicated that evaporability was, at best, marginally better than predicted from the weighted average calculations (see Tables 2, 4, and 6). At elevated temperature, however, the mixtures evaporated faster than the calculations predict. In particular, the evaporability of DPnP at 77° C. was 12-22% faster than expected (Table 1). For DPnB and DPtB, evaporabilities at 77° C. were up to 31% or 19% faster than expected (see Tables 3 and 5, respectively).

Optionally, compositions used in the invention contain additional components commonly used in the drycleaning industry. For example, the compositions can include other organic solvents, such as other glycol ethers, glycol esters, glycol ether esters, alcohols ($C_8$-$C_{12}$ aliphatic alcohols) or the like, and mixtures of these. The compositions can also contain detergents, anti-static agents, surfactants, fabric softeners, brighteners, disinfectants, anti-redeposition agents, fragrances, and the like. For more on conventional additives, see U.S. Pat. No. 6,086,634, the teachings of which are incorporated herein by reference.

A variety of well-known drycleaning techniques can be employed. In a first step, garments and/or other drycleanable articles are agitated in the presence of a cleaning composition. In commercial processes, garments are typically rotated in a tumble-type washer that contains a drycleaning solvent, detergents, and other additives. The cleaning composition is drained from the tumbler, and the garments are spun to remove the cleaning composition from the garments. The garments are then contacted in a dryer with heated air to remove the remaining cleaning composition. The temperature of the heated air can be adjusted to optimize removal of the remaining cleaning composiiton. For practicing this invention, a temperature range of 50 to 90° C. is preferred for removing the remaining cleaning composition. In our experiments, we used 77° C., to simulate typical drycleaning conditions. The cleaning composition is preferably recovered and reused. If desired, it can be purified by adsorption, distillation, or a combination of these methods.

The following examples merely illustrate the invention. Those skilled in the art will recognize many variations that are within the spirit of the invention and scope of the claims.

Test Methods

A. Method for Measuring Evaporation Time at Room Temperature

A Falex evaporometer is calibrated and the evaporation times of the solvents are measured according to ASTM D 3539-87, with two exceptions. The evaporation times are recorded when 100% of the solvent evaporates (rather than 90%), and the data is collected electronically (rather than using a strip chart). Calibration of the evaporometer is performed with n-butyl acetate by adjusting the "air-flow" ports ($N_2$ gas, 21 L/min), until the evaporation time of n-butyl acetate is 470±10 sec. After the instrument is calibrated, 0.7 mL of a solvent blend is added to the filter paper. The evaporation time at room temperature is measured when approximately 100% of the solvent has evaporated from the filter paper. Room temperature evaporability results for mixtures containing DPnP, DPnB, and DPtB are reported in Tables 2, 4, and 6, respectively.

B. Method for Measuring Evaporation Time at 77° C.

An 8.5"×11" piece of neutral worsted flannel cloth (wool oil content <0.5%, Test Fabrics Inc. #523) is folded in half four times, stapled together (at the corner, to form a pad), and trimmed at the edges until the weight is 10±0.1 g. After 2 g±0.1 of solvent (see Tables 1, 3, and 5 at columns 1 and 2 for compositions) is added to the pad, it is placed into a forced draft oven, which is maintained at 77° C. Periodically, the cloth is removed from the oven and weighed until 100% of the solvent has evaporated. Evaporability results at 77° C. for mixtures containing DPnP, DPnB, and DPtB are reported in Tables 1, 3, and 5, respectively.

Sample Calculations

1. Predicted Evaporation Times

At 77° C.:

DPnP and Water/DF-2000 Composition (90/10)

Actual $ET_{(100\%\ DPnP/H2O)}$×(*DPnP*/$H_2O$ *wt.* %)=2,800×0.90=2,520 *s*

Actual $ET_{(100\%\ DF\text{-}2000)}$×(*DF*-2000 *wt.* %)=760×0.10=76 *s*

Total=2,520+76=2,596 *s*

At Room Temperature:

DPnP and Water/DF-2000 Composition (80/20)

Actual $ET_{(100\%\ DPnP/H2O)}$×(*DPnP*/$H_2O$ *wt.* %)=47,000×0.80=37,600 *s*

Actual $ET_{(100\%\ DF\text{-}2000)}$×(*DF*-2000 *wt.* %)=10,000×0.20=2,000 *s*

Total=37,600+2,000=39,600 *s*

2. Calculated Reduction in Evaporation Time

At 77° C.:

(Predicted *ET*−Actual *ET*)/Predicted *ET*×100=(2,596−2,100 *s*)/2,596 *s*×100=19%

At Room Temperature:

(39,600−38,000 *s*)/39,600 *s*×100=4.0%

TABLE 1

Evaporability of DPnP, Water, and Hydrocarbons at 77° C.

| DPnP:$H_2O$ (95:5) (%) | DF-2000 (%) | Actual evaporation time (s) | Predicted evaporation time (s) | Actual evaporation time (s) | Faster-than-expected evaporability (%) |
|---|---|---|---|---|---|
| 100 | 0 | 2,800 | | | |
| 90 | 10 | | 2,596 | 2,100 | 19 |
| 80 | 20 | | 2,392 | 2,100 | 12 |
| 65 | 35 | | 2,086 | 1,700 | 19 |
| 50 | 50 | | 1,780 | 1,380 | 22 |
| 0 | 100 | 760 | | | |

TABLE 2

Evaporability of DPnP, Water, and Hydrocarbons at Room Temperature

| DPnP:$H_2O$ (95:5) (%) | DF-2000 (%) | Actual evaporation time (s) | Predicted evaporation time (s) | Actual evaporation time (s) | Faster-than-expected evaporability (%) |
|---|---|---|---|---|---|
| 100 | 0 | 47,000 | | | |
| 90 | 10 | | 43,300 | | |
| 80 | 20 | | 39,600 | 38,000 | 4.0 |
| 65 | 35 | | 34,050 | | |
| 50 | 50 | | 28,500 | 27,000 | 5.3 |
| 0 | 100 | 10,000 | | | |

TABLE 3

Evaporability of DPnB, Water, and Hydrocarbons at 77° C.

| DPnB:$H_2O$ (95:5) (%) | DF-2000 (%) | Actual evaporation time (s) | Predicted evaporation time (s) | Actual evaporation time (s) | Faster-than-expected evaporability (%) |
|---|---|---|---|---|---|
| 100 | 0 | 3930 | | | |
| 90 | 10 | | 3663 | 3000 | 18 |
| 80 | 20 | | 3396 | 2520 | 26 |
| 70 | 30 | | 3129 | 2160 | 31 |
| 0 | 100 | 1260 | | | |

TABLE 4

Evaporability of DPnB, Water, and Hydrocarbons at Room Temperature

| DPnB:$H_2O$ (95:5) (%) | DF-2000 (%) | Actual evaporation time (s) | Predicted evaporation time (s) | Actual evaporation time (s) | Faster-than-expected evaporability (%) |
|---|---|---|---|---|---|
| 100 | 0 | 111,500 | | | |
| 90 | 10 | | 101,350 | 103,860 | −2.5 |
| 80 | 20 | | 91,200 | 90,829 | 0.4 |
| 70 | 30 | | 81050 | 75,000 | 7.5 |
| 0 | 100 | 10,000 | | | |

TABLE 5

Evaporability of DPtB, Water, and Hydrocarbons at 77° C.

| DPtB:$H_2O$ (95:5) (%) | DF-2000 (%) | Actual evaporation time (s) | Predicted evaporation time (s) | Actual evaporation time (s) | Faster-than-expected evaporability (%) |
|---|---|---|---|---|---|
| 100 | 0 | 2370 | | | |
| 90 | 10 | | 2253 | 2244 | 0.4 |
| 80 | 20 | | 2136 | 1800 | 16 |
| 70 | 30 | | 2019 | 1644 | 19 |
| 0 | 100 | 1200 | | | |

TABLE 6

Evaporability of DPtB, Water, and Hydrocarbons at Room Temperature

| DPtB:$H_2O$ (95:5) (%) | DF-2000 (%) | Actual evaporation time (s) | Predicted evaporation time (s) | Actual evaporation time (s) | Faster-than-expected evaporability (%) |
|---|---|---|---|---|---|
| 100 | 0 | 48,600 | | | |
| 90 | 10 | | 44,740 | 44,460 | 0.6 |
| 80 | 20 | | 40,880 | 38,370 | 6.1 |
| 70 | 30 | | 37,020 | 33,920 | 8.4 |
| 0 | 100 | 10,000 | | | |

We claim:

1. A method which comprises drycleaning a fabric or fiber at a temperature within the range of 77 to 90° C. using a composition comprising 45 to 80 wt. % of a dipropylene glycol $C_3$-$C_4$ alkyl ether, 20 to 50 wt. % of one or more $C_{10}$-$C_{15}$ hydrocarbons, and 2 to 5 wt. % of water.

2. The method of claim 1 wherein the composition comprises 60 to 70 wt. % of the dipropylene glycol $C_3$-$C_4$ alkyl ether.

3. The method of claim 1 wherein the composition comprises 30 to 50 wt. % of the hydrocarbons.

4. The method of claim 1 wherein the hydrocarbons have a flash point greater than 60° C.

5. The method of claim 1 wherein the composition comprises 2.5 to 4 wt. % of water.

6. The method of claim 1 wherein the dipropylene glycol $C_3$-$C_4$ alkyl ether is dipropylene glycol n-propyl ether.

7. The method of claim 1 wherein the dipropylene glycol $C_3$-$C_4$ alkyl ether is dipropylene glycol n-butyl ether.

8. The method of claim 1 wherein the dipropylene glycol $C_3$-$C_4$ alkyl ether is dipropylene glycol t-butyl ether.

9. The method of claim 1 wherein the fabric is used in a garment, bedding, furniture covering, rug, wall covering, drapery, napkin, or tablecloth.

10. The method of claim 1 wherein the fiber is selected from the group consisting of cotton, wool, silk, rayon, polyester, nylon, acetates, polyolefins, acrylics, spandex, and blends thereof.

11. A method which comprises: (a) agitating garments in the presence of a cleaning composition comprising 45 to 80 wt. % of a dipropylene glycol $C_3$-$C_4$ alkyl ether, 20 to 50 wt. % of one or more $C_{10}$-$C_{15}$ hydrocarbons, and 2 to 5 wt. % of water; (b) separating most of the cleaning composition from the garments; and (c) contacting the garments with air heated at a temperature within the range of 77 to 90° C. to remove the remaining cleaning composition from the garments.

12. The method of claim 11 wherein the cleaning composition further includes a detergent, anti-static agent, surfactant, fabric softener, brightener, disinfectant, anti-redeposition agent, fragrance, or a mixture thereof.

13. The method of claim 11 further comprising purifying the separated cleaning composition from step (b) by adsorption, distillation, or a combination of these methods.

* * * * *